US006572909B1

(12) United States Patent
Bagwell et al.

(10) Patent No.: US 6,572,909 B1
(45) Date of Patent: Jun. 3, 2003

(54) CONTAINER HAVING SINGLE-CYCLE HINGE AND USE THEREOF

(75) Inventors: Terry Steven Bagwell, Thomaston, GA (US); W. John Squire, Atlanta, GA (US)

(73) Assignee: De Ster Corporation, Atlanta, GA (US)

( * ) Notice: Subject to any disclaimer, the term of this patent is extended or adjusted under 35 U.S.C. 154(b) by 0 days.

(21) Appl. No.: 09/563,520

(22) Filed: May 3, 2000

(51) Int. Cl.[7] ..... B65D 17/24; B65D 43/02; B65D 7/26; B65D 69/00

(52) U.S. Cl. ..... 426/394; 426/115; 426/112; 426/122; 220/4.22; 220/4.23; 220/837; 220/839; 220/266; 206/216; 206/469

(58) Field of Search ..... 220/4.22, 4.23, 220/837, 838, 839, 266; 426/392, 394, 115, 112, 106, 122, 123; 206/216, 469, 470

(56) References Cited

U.S. PATENT DOCUMENTS

| | | | | | |
|---|---|---|---|---|---|
| 2,915,214 | A | * | 12/1959 | Frankel | |
| 3,790,062 | A | * | 2/1974 | Boyd | 229/2.5 |
| 3,937,389 | A | | 2/1976 | Wind | 229/2.5 R |
| 4,132,344 | A | | 1/1979 | Jewell | 229/2.5 R |
| 4,189,054 | A | | 2/1980 | Liu et al. | 206/634 |
| 5,145,088 | A | * | 9/1992 | Goujon | 220/335 |
| 5,366,104 | A | | 11/1994 | Armstrong | 220/339 |
| 5,577,627 | A | | 11/1996 | Richie-Dubler | 220/4.23 |
| 5,851,634 | A | * | 12/1998 | Anderson et al. | 428/159 |
| 5,860,549 | A | | 1/1999 | Allers et al. | 220/4.23 |
| 5,897,011 | A | * | 4/1999 | Brilliant | 220/4.23 |
| 5,938,068 | A | * | 8/1999 | Atkins et al. | 220/839 |
| 5,957,275 | A | | 9/1999 | Lemaire | 206/83 |

* cited by examiner

*Primary Examiner*—Milton I. Cano
*Assistant Examiner*—Robert A. Madsen
(74) *Attorney, Agent, or Firm*—Baker, Donelson, Bearman & Caldwell

(57) ABSTRACT

A plastic container has a base and a lid hinged together by a hinge. The hinge has a series of relatively thick sections joined together by a series of relatively thin sections. The thin sections are sufficiently thin to be severed upon an initial folding of the hinge. The thick sections are sufficiently thick to remain at least partially intact during the initial folding. The container may be filled with product and closed with the hinge becoming partially severed and weakened and may be later opened with the hinge becoming completely severed to separate the base and the lid.

19 Claims, 6 Drawing Sheets

CONTAINER HAVING SINGLE-CYCLE HINGE AND USE THEREOF

TECHNICAL FIELD

This invention relates generally to plastic containers having a lid, a base and a hinge joining the lid to the base.

BACKGROUND OF THE INVENTION

Plastic containers have long been used to carry food from a cafeteria, grocery store or restaurant for consumption at another location. Such containers have typically included a base and a lid sized and shaped to matingly engage the edges of one another for securely enclosing food items prior to storing and transporting the items. These containers are commonly thermoformed from a sheet of thermoplastic material.

Some of these containers are manufactured, sold and used in two separate pieces as individual lids and bases. Often the lids and the bases are made of like shapes and sizes so that the lids and the bases may nest within one another when not secured to one another along their edges. A drawback to such two-piece containers is that they are inefficient to use as the lids corresponding to the bases must be matched and aligned to the bases prior to joining them to the bases.

Some plastic containers have overcome this drawback by hinging together the bases and the lids. These hinged containers are manufactured, sold and used as integral one piece units. The hinges of such containers are often comprised of one or more fold lines or creases in-between the lid and the base as shown for example in U.S. Pat. No. 5,860,549. The hinges allow the lid to be folded and unfolded repeatedly onto the base along the fold line. This efficiency of the one-piece container is particularly appreciated by persons involved in the packing of food into the containers as they are able to efficiently load food into the base without concern for later locating matching lids, and aligning the edges of the lids with the edges of the bases to close the filled container.

While solving the inefficiencies of the two piece containers, such one-piece containers have nevertheless created another drawback. In particular, one seeking to consume food packed in the container will commonly use the base of the container as a dinner plate. As such, the consumer opens the container by raising the lid to expose his or her dinner food placed upon the base. The lid of the opened container, although raised, nevertheless remains cumbersomely attached to the base. This is awkward as the lid may refold upon the base on its own. Even if it remains folded out the lid causes the container to consume twice the table space. Often such space is very limited as in airliners.

Recognizing this drawback, some users have attempted to remove the lid from the base with food contained in the base. One method of doing so requires scissors or a sharp knife to cut the hinge into two pieces thereby separating the lid from the base. Such cutting is extremely troublesome and dangerous as the plastic from which such containers are typically made is durable and difficult to cut, particularly while simultaneously trying to prevent food from spilling from such containers. Moreover, it requires a utensil that is not often present.

Accordingly, there remains a need for a plastic container that provides the advantages of having a base and a lid hinged together for manufacture, storage and transportation, yet without the disadvantage of remaining intact during consumption of its contents. It is to the provision of such that the present invention is directed.

SUMMARY OF THE INVENTION

The present invention meets the above-described need in the art by providing in a preferred form of the invention a plastic container having a base and a lid hinged together by a hinge. The hinge has a series of relatively thick sections joined together by a series of relatively thin sections. The thin sections are sufficiently thin to be severed upon an initial folding of the hinge. The thick sections are sufficiently thick to remain at least partially intact during the initial folding. With this construction, the container may be filled with product and closed with the hinge becoming partially severed and weakened and may be later opened with the hinge becoming completely severed to separate the base and the lid.

In another preferred form of the invention, a method of packaging and unpackaging food products comprises the steps of placing food in the base of an open plastic container having a lid and a base joined by a hinge, closing the lid onto the base and partially fracturing the hinge, and subsequently re-opening the container and completely fracturing the hinge thereby providing access to the product in the base with the lid unattached.

DETAILED DESCRIPTION

Figure 1:
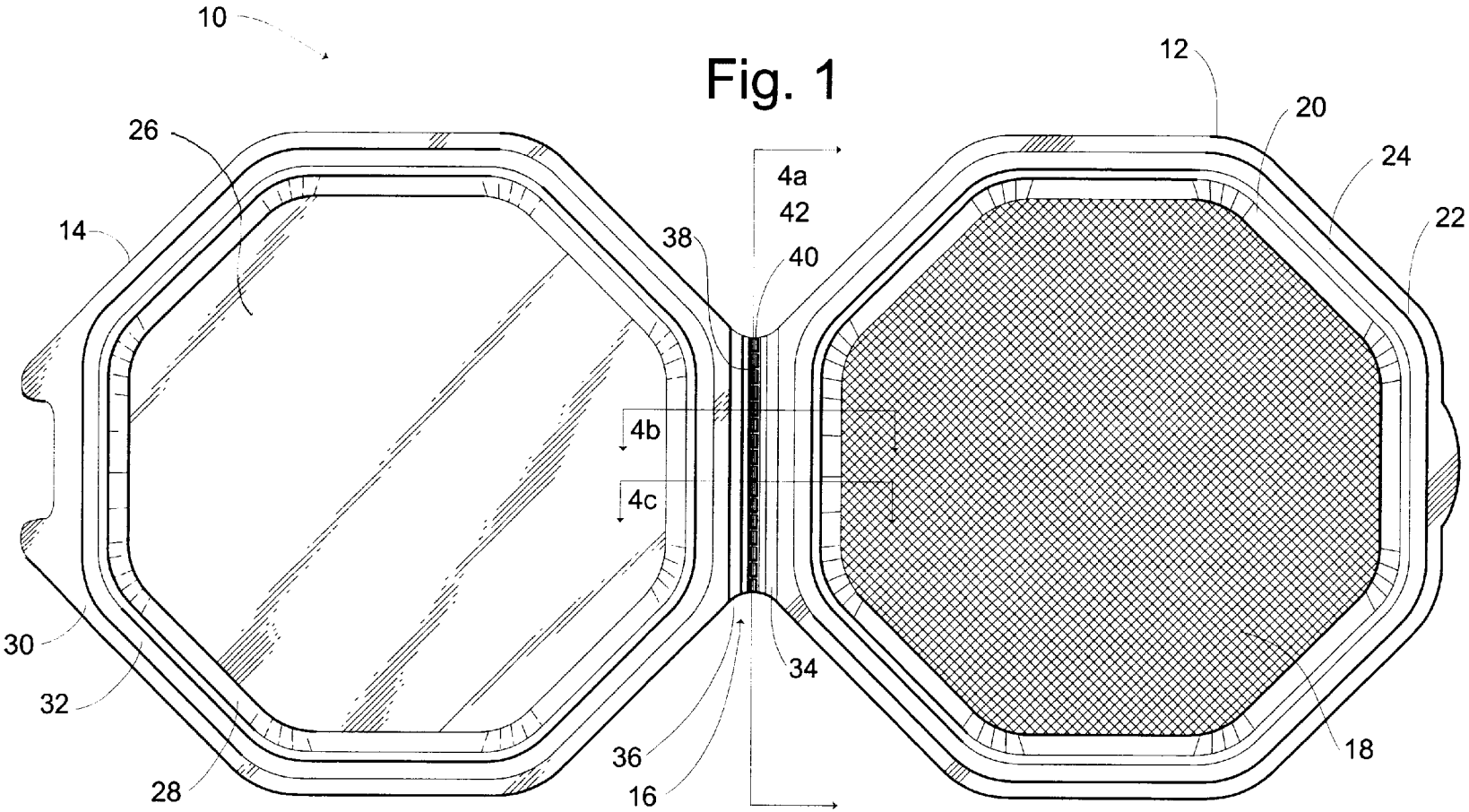
FIG. 1 is a top view of a container that embodies principles of the invention in its preferred form with the container shown fully opened.

Referring now in more detail to the drawings in which like numerals refer to like parts throughout the several views, FIG. 1 illustrates a container 10 having a base 12, a lid 14 and a hinge 16 joining the lid to the base. The container 10 is thermoformed from a sheet of thermoplastic material preferably including a polypropylene or polyethylene resin. The base 12 has a bottom 18 and sides 20 that border the bottom. A bottom lip 22 extends from an upper portion of the sides 20. A protrusion 24 is formed in the bottom lip 22. The lid 14 has a top 26 and sides 28 that border the top. A top lip 30 extends from an upper portion of the sides 28. A groove 32 is formed in the top lip 30. The protrusion 24 and the groove 32 are sized and shaped to matingly engage one another in a tongue and groove manner.

The hinge 16 is integrally formed to a side edge 34 of the base 12 and to a side edge 36 of the lid 14. The hinge 16 has a series of thin sections 38 and a series of thick sections 40. The hinge 16 extends along an axis 42 between the base 12 and the lid 14. The axis 42 is the fulcrum about which the base 12 and the lid 14 pivot. The axis 42 is preferably positioned to enable the flange 24 of the base 12 to engage the groove 30 of the lid 14.

Figure 2:
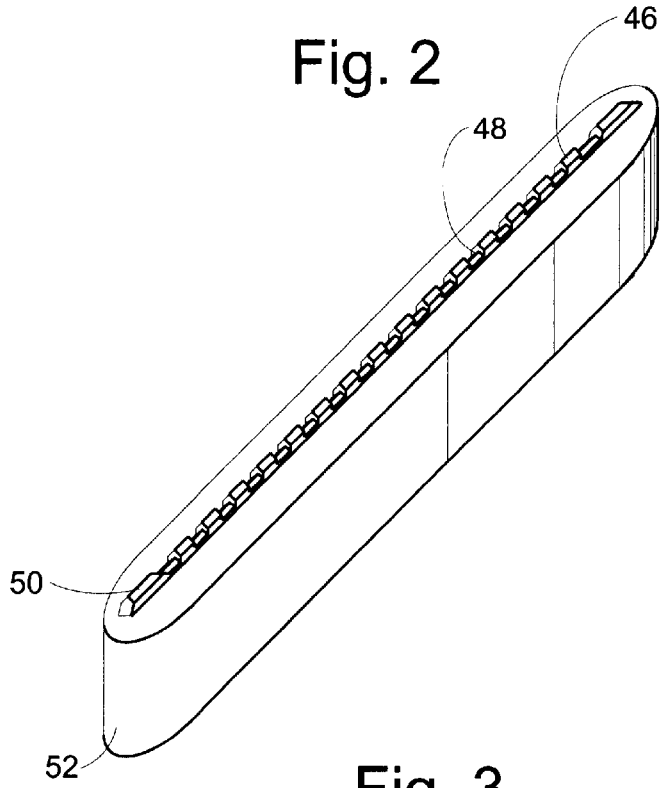
FIG. 2 is a perspective view of a blade used to form the hinge of the container illustrated in FIG. 1.

A brief description of some of the tools used to form the hinge 16 facilitates an understanding of the construction of the hinge. FIG. 2 illustrates a blade 44 used to impregnate or coin a sheet of plastic material to form the hinge 16. The blade 44 has a series of upper teeth 46 and a series of lower teeth 48 attached to a ridge 50. The ridge 50 is mounted to a block 52. The upper teeth 46 are preferably 1.4 millimeters in height as measured from the block 52. The lower teeth 48 are preferably 1.1 millimeters in height as measured from the block 52.

Figure 3:
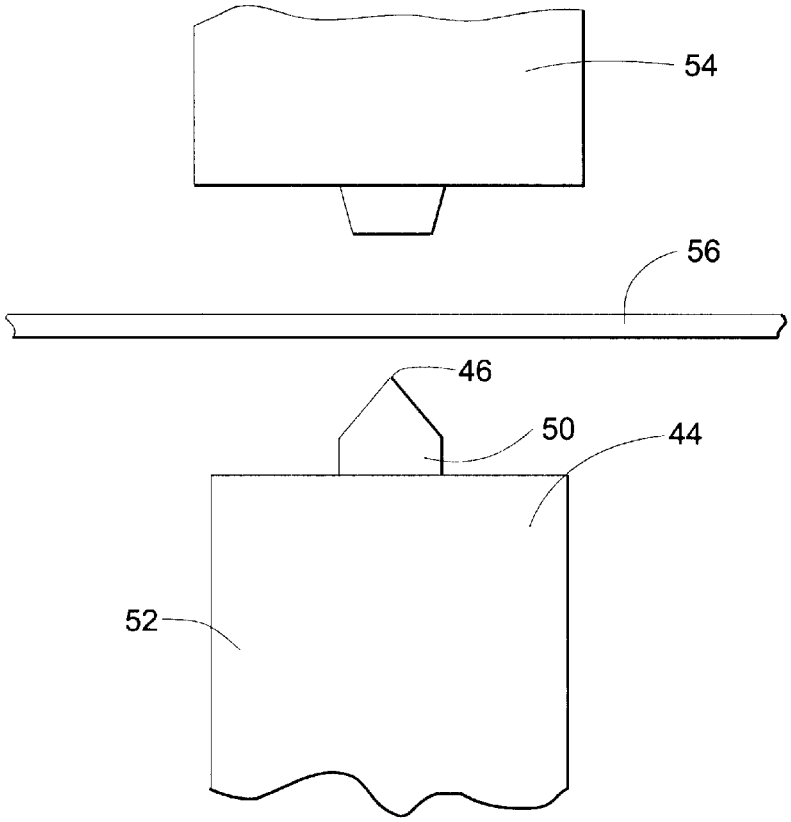
FIG. 3 is a side view of the blade shown in FIG. 2 a showing a sheet of plastic material between the blade and a striker plate.

FIG. 3 illustrates a side view of the blade 44 and of a striker plate 54 against which the blade coins a sheet of plastic material 56. During the process of thermoforming the container 10, the plastic material 56 is squeezed between the blade 44 and the striker plate 54. The compressive force of the upper teeth 46 against the striker plate 54 forms the thin sections 38 of the hinge 16. The compressive force of the lower teeth 48 against the striker plate 54 forms the thick sections 40 of the hinge 16. In addition, the compression of the teeth 46 and 48 against the striker plate 54 carves out large and small indentations 58 and 60 in the plastic sheet 56 as best shown in FIGS. 4*a–c*.

Figure 4A:
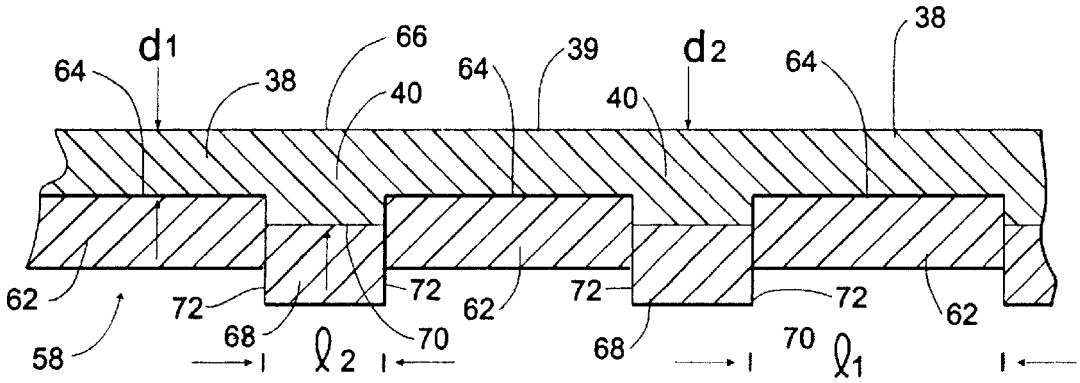
FIGS. 4*a–c* are fragmentary views in cross-sections of the hinge illustrated in FIG. 1.
Figure 4B:
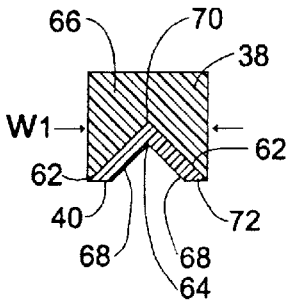
Figure 4C:
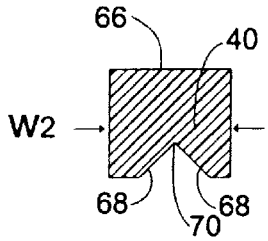

FIG. 4*a* is a cross-sectional view of a section of the hinge 16 taken along the plane 4*a*—4*a* in FIG. 1. Each of the thin sections 38 includes a pair of upper inclined walls 62 that intersect at an upper crease 64. Each of the thin sections 38 extends between the upper inclined walls 62 and a top hinge surface 66. The top hinge surface 66 is preferably a planar surface formed by the striker plate 54. Each of the thick sections 40 includes a pair of lower inclined walls 68 that intersect at a lower crease 70, and a pair of side walls 72. Each of the thick sections 40 extends between the lower inclined walls 68 and the top hinge surface 66.

The gauge of the sheet of thermoplastic material 56 from which the container 10 is formed is preferably 25 to 70 microns. The depths $d_1$ of the thin sections 38 between the upper crease lines 64 and the top hinge surface 66 are preferably about 25 percent to 50 percent of the gauge of the thermoplastic sheet 56. The depths $d_2$ of the thick sections 40 between the lower crease lines 70 and the top hinge surface 66 are preferably between about 75 percent and 95 percent of the gauge of the thermoplastic sheet 56. The lengths $l_1$ of the thin sections 38 between the side walls 72 are preferably about 4 millimeters. The lengths 12 of the thick sections 40 between the side walls 72 are preferably about 2 millimeters.

Of course, the depths $d_1$ and $d_2$ and the lengths $l_1$ and $l_2$ vary depending upon the type, the durability and the gauge of thermoplastic material used to form the hinge 16. Also, there is some variation in the exact measurements of thermoplastic material from which the containers 10 are made. Based upon the differences in the dimensions of the teeth 46 and 48 of the blade 44, the depths $d_1$ of the thin sections 38 are preferably about 15–25 percent less than the depths $d_2$ of the thick sections 40. The lengths $l_1$ of the thin sections 38 are preferably about twice the lengths $l_2$ of the thick sections 40.

FIGS. 4*b* and 4*c* are cross-sectional views of the hinge 16 taken along the planes 4*b*—4*b* and 4*c*—4*c* in FIG. 1. The thin sections 38 and the thick sections 40 align along the axis 42. The widths $w_1$ of the thin sections 38 and the widths $W_2$ of the thick sections 40 are preferably 1.2 millimeters. However, the widths w, of the thin sections 38 and the widths $w_2$ of the thick sections 40 need not be the same. The upper inclined walls 62 of the thin sections 38 form a V-shape. The lower inclined walls 68 of the thick sections also form a V-shape. The side walls 72 of the thick sections 40 together with the upper inclined walls 62 of the thin sections 38 define the large indentations 58. The lower inclined walls 68 define the small indentations 60.

Figure 5:
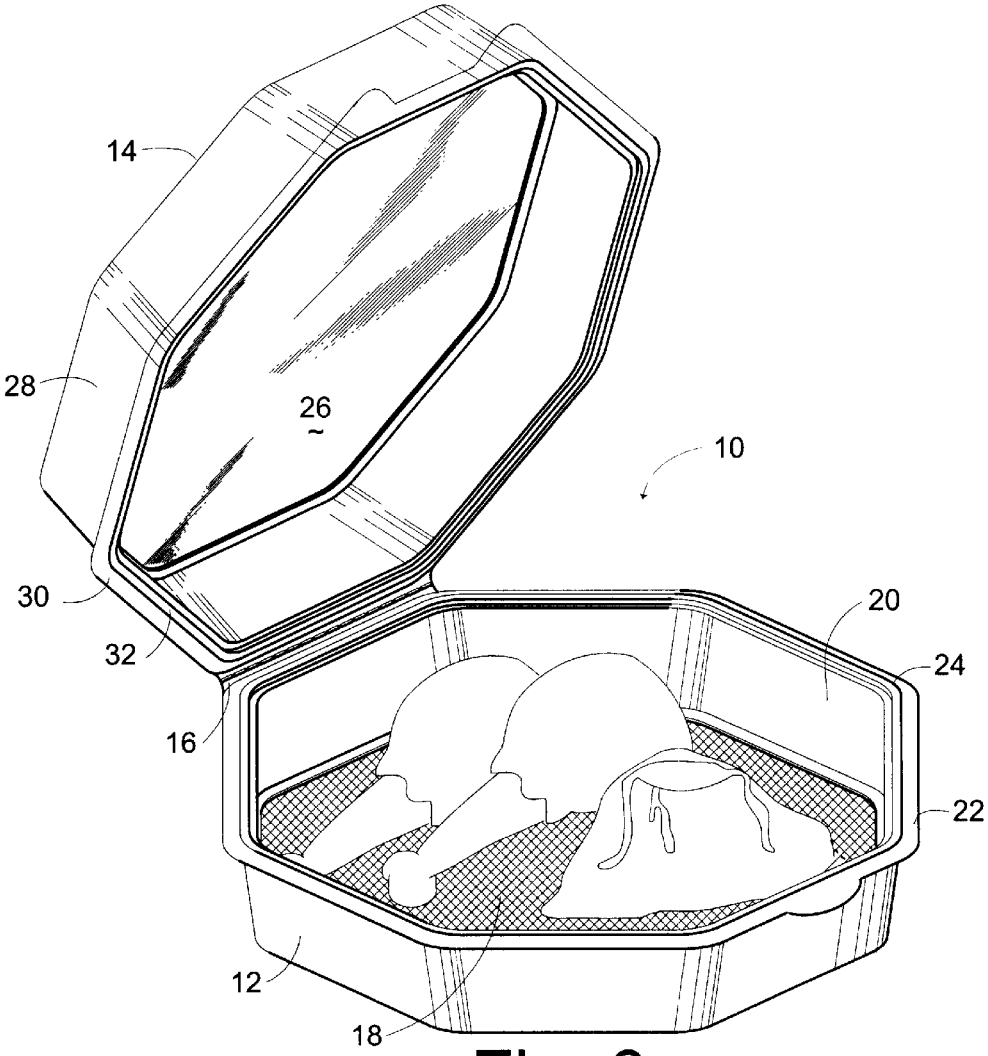
FIG. 5 is a perspective view of the container shown in FIG. 1 containing food in a partially closed position.
Figure 6:
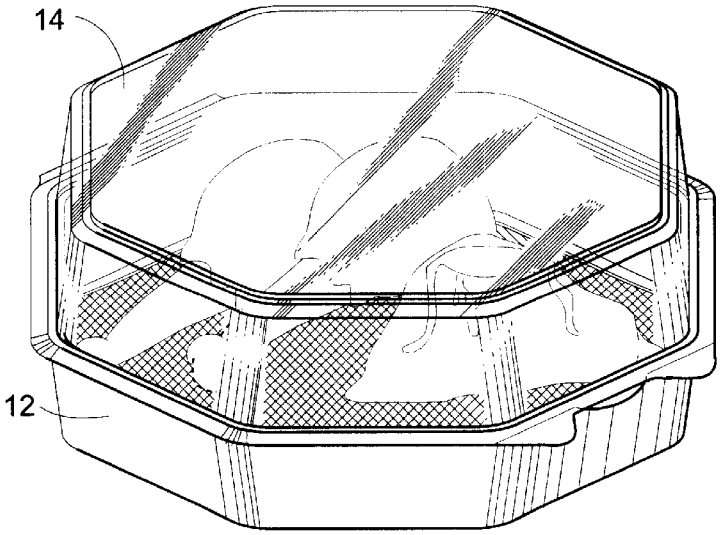
FIG. 6 is a perspective view of the container shown in FIG. 5 illustrating the container in a fully closed position.
Figure 7:
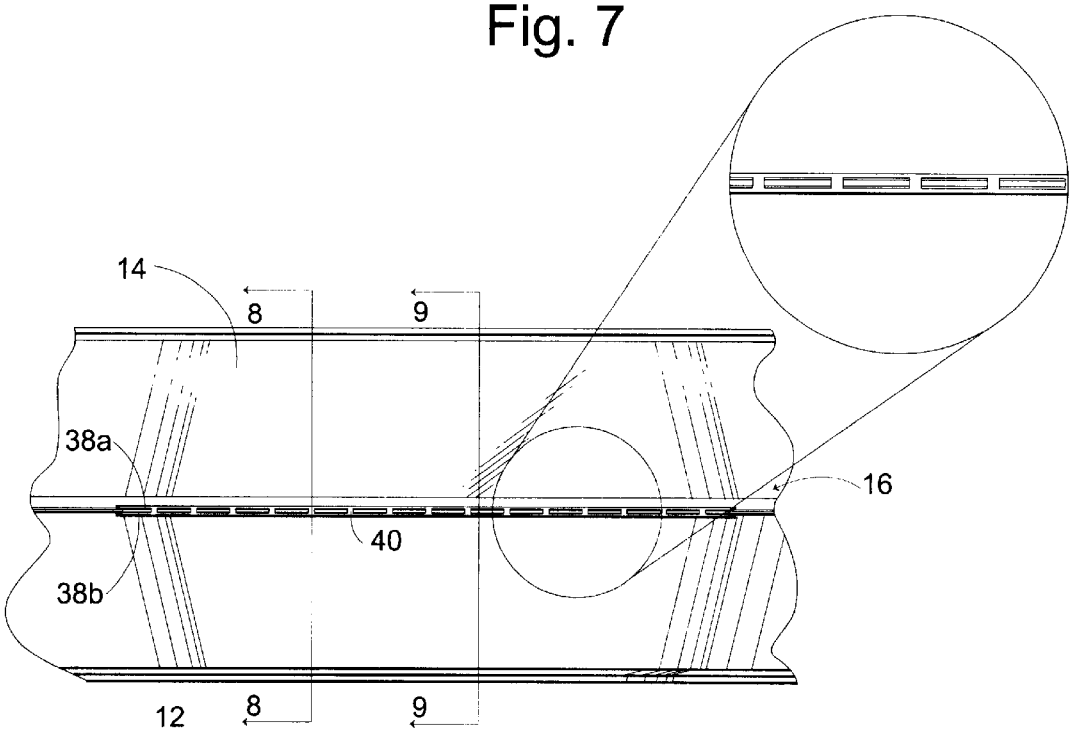
FIG. 7 is an end view of a portion of the container in its fully closed position.
Figure 8:
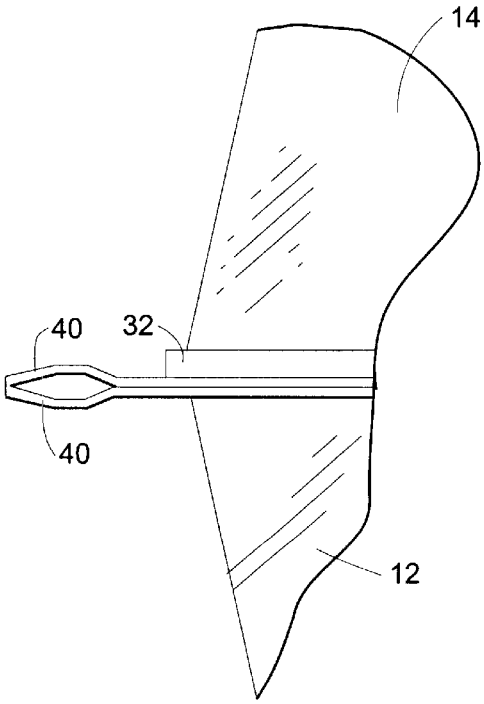
FIG. 8 is an enlarged cross-sectional side view of the container taken along the plane 8—8.
Figure 9:
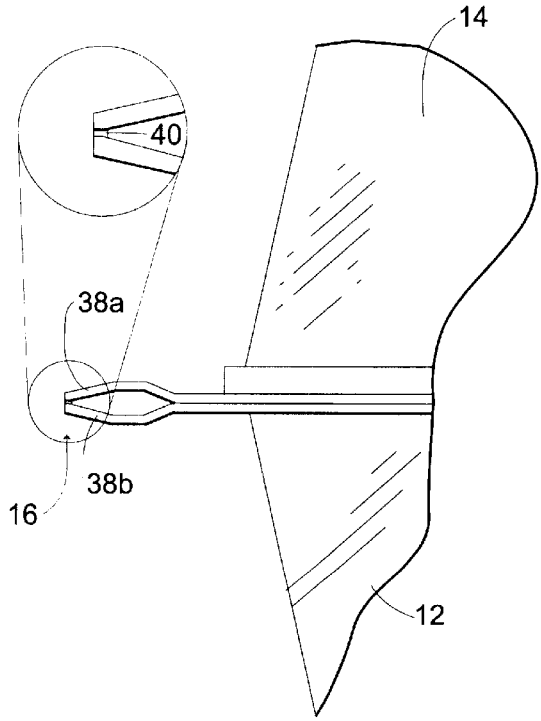
FIG. 9 is an enlarged cross-sectional side view of the container taken along the plane 9—9.

The operation of the container 10 is understood with reference to FIGS. 1 and 5–10. Beginning with FIG. 1, the container 10 is typically used initially from its open position as shown in FIG. 1. Food or other items are placed in the base 12 and the lid 14 is moved pivotally about the axis 42 from an open position to a partially closed position as shown in FIG. 5. As the lid 14 is further moved pivotally about the axis 42 to a fully closed position upon the base 12, as shown in FIG. 6, tensile stress is applied to the hinge 16 transverse to the axis 42. The thin sections 38 are sufficiently thin so that the tensile stress caused by this pivotal movement of the lid 14 toward the base 12 weakens and severs them into two pieces 38*a* and 38*b* as shown in FIGS. 7 and 8 as the container 10 is closed. The thick sections 40 are sufficiently thin so that the tensile stress applied to them transverse to the axis 42 during the initial closing action of the lid 14 upon the base 12 does not sever the thick sections.

In the fully closed position shown in FIGS. 6–9, the thick sections 40 of the hinge 16 are at least partially intact. Thus, even though the thin sections 38 are being severed while the container 10 is being closed, the thick sections 40 provide some stability to the container 10 so that the tongue 24 may be aligned and engaged to the groove 32 prior to the hinge 16 fully severing.

Figure 10:
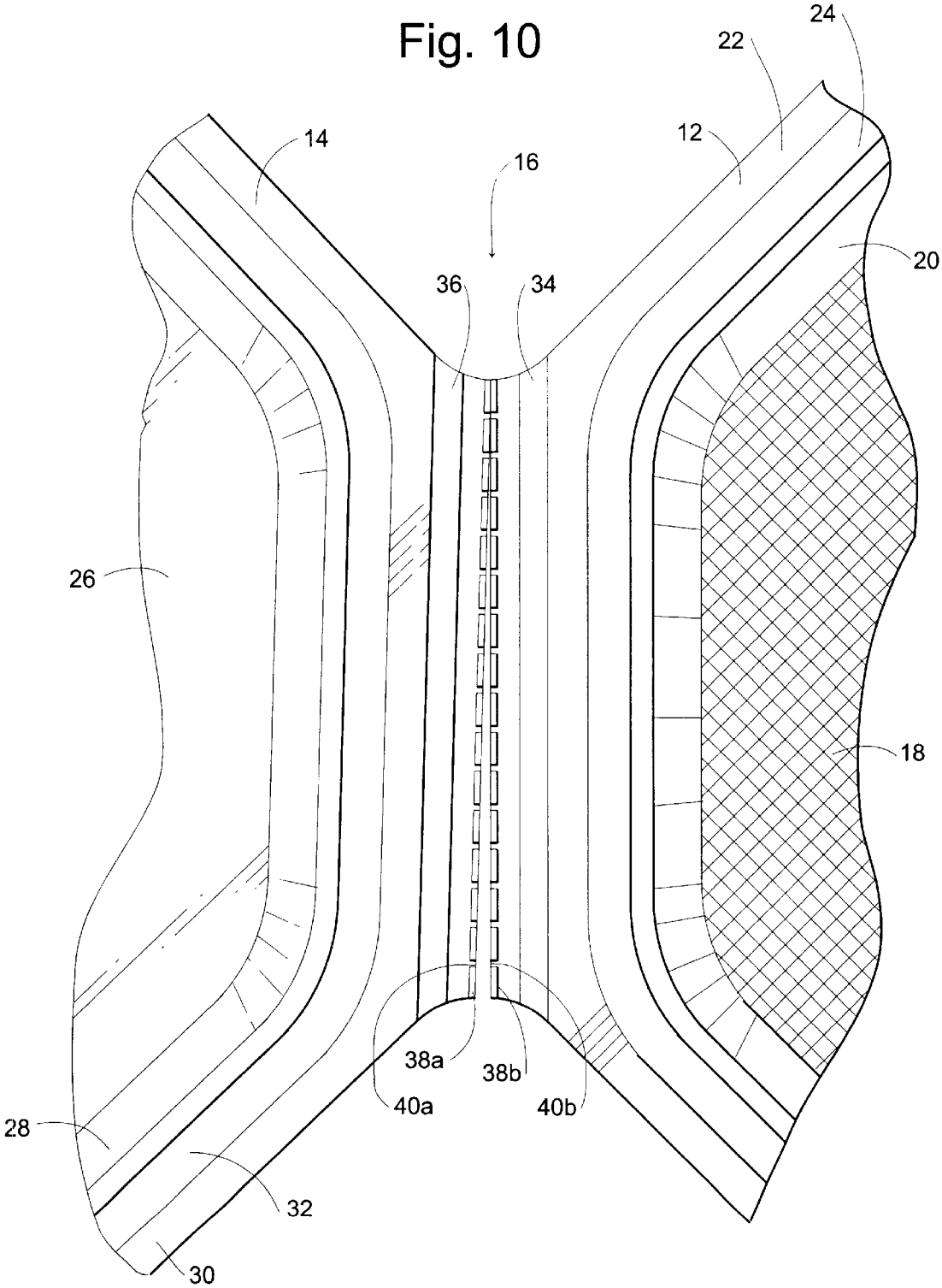
FIG. 10 is a top view of the container shown in FIG. 1 illustrating the hinge being severed.

Upon reopening of the container 10 by disengaging the tongue 24 from the groove 32 and pivotally moving the lid 14 away from the base 12, the thick sections 40 sever into two pieces 40*a* and 40*b* as shown in FIG. 10. The thick sections 40 are sufficiently thin so that they cannot withstand the force caused by pivotally reopening the container 10. It should be noted that the initial closing action of the container 10 partially weakens the thick sections 40. Thus, upon reopening the container 10, the thick sections 40 are further weakened and severed into two pieces 40*a* and 40*b*.

In this manner, the container 10 converts from a one-piece container to a two-piece container after one full cycle of closing and re-opening. Once re-opened, the separate lid 14 and the separate base 12 may be fitted or nested together with the lid placed directly under the base. In this nested configuration, the top lip 30 and the bottom lip 22, the top sides 28 and the bottom sides 20, top 26 and the bottom 18 each lie in essentially parallel planes to one another. Thus, the lid 14 may be compactly stored under the base 12 to provide double the support and double the insulation of the base. This is particularly useful where the container 10 is used to carry hot or heavy food. Also, the base 12 may be used apart or together with the lid 14 to contain and heat food as in a microwave.

Preferably the thick sections 40 fully sever as the lid 14 is moved to a fully opened position as shown in FIG. 10. However, because of the variations in thermoplastic material and in the manufacturing process, the thick sections 40 may not fully sever as shown in FIG. 10. In such circumstances, the lid 14 and the base 12 may be pulled slightly apart to complete the severing of the thick sections 40.

The preferred thermoplastic material 56 used to form the container 10 includes a polypropylene or polyethylene blend of resins. Some of such thermoplastic materials include polystyrene, oriented polystyrene, polyethylene terephthalate, amphbrous polyethylene terephthalate (APET), and crystallized polyethylene terephthalate (CPET). However, plastic sheets comprised of other plastic resins may be used to form the container.

It thus is seen that a plastic container is now provided that overcomes problems long associated with those of prior art. It should be understood however that many modifications, additions and deletions may be made thereto without departure from the spirit and scope of the invention as set forth in the following claims.

What is claimed is:

1. A plastic container having a base and a lid hinged together by a hinge that has a series of relatively thick sections joined together by a series of relatively thin sections, said thin sections being sufficiently thin to be severed upon an initial folding of said hinge and said thick sections being sufficiently thick to remain at least partially intact during the initial folding whereby the container may be filled with product and closed with the hinge becoming partially severed and weakened and may be later opened with the hinge becoming completely severed to separate the base and the lid.

2. The plastic container of claim 1 wherein said hinge extends along an axis between said base and said lid and said thin sections and said thick sections are aligned along said axis.

3. The plastic container of claim 1 comprised of a thermoplastic resin selected from the group consisting of polyethylene or polystyrene.

4. The plastic container of claim 1 wherein the lengths of said thin sections are approximately twice the lengths of said thick sections.

5. The plastic container of claim 1 wherein said thick sections have a thickness approximately 50 percent to 75 percent greater than the thickness of said thin sections.

6. The plastic container of claim 1 wherein said thin sections have a substantially V-shaped cross-section.

7. The plastic container of claim 1 wherein said thick sections have a substantially V-shaped cross-section.

8. A method of packaging and unpackaging products which comprises the steps of placing a product in the base of an open plastic container having a lid and a base joined by a hinge that has a series of relatively thick sections joined together by a series of relatively thin sections, said thin sections being sufficiently thin to be severed upon an initial folding of said hinge and said thick sections being sufficiently thick to remain at least partially intact during the initial folding, closing the lid onto the base and partially fracturing the hinge, and subsequently re-opening the container and completely fracturing the hinge thereby providing access to the product in the base with the lid unattached.

9. The method of claim 8 wherein the product is heated and further comprising an additional step of nesting the base containing the heated product upon the lid to assist in keeping the product warm.

10. The method of claim 8 wherein the base and the product are heated and further comprising an additional step of nesting the heated base and the heated product upon the lid to assist in keeping the product warm.

11. A hinge formed in a sheet of thermoplastic material, said sheet having a base portion and a lid portion and said hinge having a series of relatively thick sections and a series of relatively thin sections, said thin sections being sufficiently thin to be severed upon an initial folding of said hinge and said thick sections being sufficiently thick to remain at least partially intact during the initial folding whereby the base portion may be folded upon the lid portion to partially sever and weaken the hinge and may be later unfolded to fracture the hinge and thereby separate the base portion of the sheet from the lid portion of the sheet.

12. The hinge of claim 11 wherein an axis extends between said base portion and said lid portion and said thin sections and said thick sections are aligned along said axis.

13. The hinge of claim 11 comprised of a thermoplastic resin selected from the group consisting of polyethylene or polystyrene.

14. The hinge of claim 11 wherein the lengths of said thin sections are approximately twice the lengths of said thick sections.

15. The hinge of claim 11 wherein said thick sections have a thickness approximately 50 percent to 75 percent greater than the thickness of said thin sections.

16. The hinge of claim 11 wherein said thin sections have a substantially V-shaped cross-section.

17. The hinge of claim 11 wherein said thick sections have a substantially V-shaped cross-section.

18. The hinge of claim 11 wherein said hinge is formed by compressing said sheet between a blade and a striker plate.

19. The hinge of claim 18 wherein said blade includes a series of upper teeth and a series of lower teeth used to form said thin sections and said thick sections of said hinge.

* * * * *

UNITED STATES PATENT AND TRADEMARK OFFICE

CERTIFICATE OF CORRECTION

PATENT NO. : 6,572,909 B1 
DATED : June 3, 2003
INVENTOR(S) : Terry Steven Bagwell and W. John Squire It is certified that error appears in the above-identified patent and that said Letters Patent is hereby corrected as shown below:

Column 5, line 14 - Column 6, line 46,
The claims should be amended as follows:

--1. A plastic container having a base and a lid hinged together by a hinge having a fulcrum imparting relative movement between said base and said lid, said hinge fulcrum has a series of relatively thick sections joined together by a series of relatively thin sections, said thick sections and said thin sections extending along the entire length of said fulcrum, said thin sections being sufficiently thin to be severed upon an initial folding of said hinge and said thick sections being sufficiently thick to remain at least partially intact during the initial folding yet sufficiently ~~thin to~~ fracture upon reciprocal folding movement of said lid, whereby the container may be filled with product and closed with the hinge becoming partially severed and weakened and may be later opened with the hinge becoming completely severed to separate the base and the lid.

2. The plastic container of claim 1 comprised of a thermoplastic resin selected from the group consisting of polyethylene or polystyrene.

3. The plastic container of claim 1 wherein the lengths of said thin sections are approximately twice the lengths of said thick sections.

4. The plastic container of claim 1 wherein said thick sections have a thickness approximately 50 percent to 75 percent greater than the thickness of said thin sections.

5. The plastic container of claim 1 wherein said thin sections have a substantially V-shaped cross-section.

6. The plastic container of claim 1 wherein said thick sections have a substantially V-shaped cross-section.

7. A method of packaging and unpackaging products which comprises the steps of placing a product in the base of an open plastic container having a lid and a base joined by a hinge that has a fulcrum imparting relative movement between said base and said lid, said hinge fulcrum having a series of relatively thick sections joined together by a series of relatively thin sections along the entire length of said hinge fulcrum, said thin sections being sufficiently thin to be severed upon an initial folding of said hinge and said thick sections being sufficiently thick to remain at least partially intact during the initial folding, closing the lid onto the base and partially fracturing the hinge, and subsequently re-opening the container and completely fracturing the hinge along the fulcrum thereby providing access to the product in the base with the lid unattached.

8. The method of claim 7 wherein the product is heated and further comprising an additional step of nesting the base containing the heated product upon the lid to assist in keeping the product warm.

9. The method of claim 7 wherein the base and the product are heated and further comprising an additional step of nesting the heated base and the heated product upon the lid to assist in keeping the product warm.

UNITED STATES PATENT AND TRADEMARK OFFICE

CERTIFICATE OF CORRECTION

PATENT NO. : 6,572,909 B1 
DATED : June 3, 2003
INVENTOR(S) : Terry Steven Bagwell and W. John Squire It is certified that error appears in the above-identified patent and that said Letters Patent is hereby corrected as shown below:

Column 5, line 14 - Column 6, line 46 (cont'd),

10. A hinge formed in a sheet of thermoplastic material, said sheet forming a container base portion and a container lid portion and said hinge having a fulcrum having a series of relatively thick sections and a series of relatively thin sections along the entire length of said hinge fulcrum, said thin sections being sufficiently thin to be severed upon an initial folding of said hinge and said thick sections being sufficiently thick to remain at least partially intact during the initial folding yet sufficiently thin to fracture upon reciprocal folding movement of said lid, whereby the base portion may be folded upon the lid portion to partially sever and weaken the hinge and may be later unfolded to fracture the hinge and thereby separate the base portion of the sheet from the lid portion of the sheet.

11. The hinge of claim 10 wherein an axis extends between said base portion and said lid portion and said thin sections and said thick sections are aligned along said axis.

12. The hinge of claim 10 comprised of a thermoplastic resin selected from the group consisting of polyethylene or polystyrene.

13. The hinge of claim 10 wherein the lengths of said thin sections are approximately twice the lengths of said thick sections.

14. The hinge of claim 10 wherein said thick sections have a thickness approximately 50 percent to 75 percent greater than the thickness of said thin sections.

15. The hinge of claim 10 wherein said thin sections have a substantially V-shaped cross-section.

16. The hinge of claim 10 wherein said thick sections have a substantially V-shaped cross-section.

17. The hinge of claim 10 wherein said hinge is formed by compressing said sheet between a blade and a striker plate.

18. The hinge of claim 17 wherein said blade includes a series of upper teeth and a series of lower teeth used to form said thin sections and said thick sections of said hinge.--

Signed and Sealed this

Twenty-fourth Day of August, 2004

JON W. DUDAS
*Director of the United States Patent and Trademark Office*